US009796522B2

(12) United States Patent
Pearce

(10) Patent No.: US 9,796,522 B2
(45) Date of Patent: Oct. 24, 2017

(54) BAG FOR SHIPPING A CUSHION AND RELATED METHODS

(71) Applicant: Purple Innovation, LLC, Alpine, UT (US)

(72) Inventor: Tony M. Pearce, Alpine, UT (US)

(73) Assignee: Purple Innovation, LLC, Alpine, UT (US)

( * ) Notice: Subject to any disclaimer, the term of this patent is extended or adjusted under 35 U.S.C. 154(b) by 0 days.

(21) Appl. No.: 15/063,114

(22) Filed: Mar. 7, 2016

(65) Prior Publication Data

US 2017/0253421 A1 Sep. 7, 2017

(51) Int. Cl.

| | |
|---|---|
| ***B65D 33/06*** | (2006.01) |
| ***B65D 85/16*** | (2006.01) |
| ***B65D 33/02*** | (2006.01) |
| ***B65D 33/25*** | (2006.01) |

(52) U.S. Cl.

CPC ..... *B65D 85/16* (2013.01); *B65D 33/02* (2013.01); *B65D 33/06* (2013.01); *B65D 33/2591* (2013.01)

(58) Field of Classification Search

CPC ..... B65D 85/16; B65D 33/02; B65D 33/06; B65D 33/2591

USPC ..... 383/14, 16, 17, 119, 97

See application file for complete search history.

(56) References Cited

U.S. PATENT DOCUMENTS 1,413,868 A * 4/1922 O'Bryan ..... B65B 27/125 131/112
1,430,690 A * 10/1922 Schwab ..... B65D 3/12 206/407
1,909,368 A * 5/1933 Lloyd ..... B65D 75/56 229/117.11
2,954,891 A * 10/1960 Imber ..... B65D 81/3834 220/592.2

(Continued)

FOREIGN PATENT DOCUMENTS

| | | |
|---|---|---|
| DE | 29714178 U1 | 1/1998 |
| EP | 1741630 B1 | 9/2009 |
| WO | 2007106240 A2 | 9/2007 |

OTHER PUBLICATIONS

International Search Report for PCT Application No. PCT/US2017/020788 dated Jun. 2, 2017, 3 pages.

(Continued)

*Primary Examiner* — Jes F Pascua
(74) *Attorney, Agent, or Firm* — TraskBritt

(57) ABSTRACT

A bag for enclosing a cushion is disclosed. The bag comprises a tubular sleeve having first and second end pieces coupled to first and second longitudinal ends thereof, a plurality of reinforcing straps encircling a circumference of the tubular sleeve, and at least one handle extending between the plurality of reinforcing straps. The at least one handle is configured to lay flush against the tubular sleeve during shipping. Methods for packaging and shipping a cushion in the bag include roll packing a cushion into a cylindrical shape, disposing the cushion in a compressed form into the (Continued)

bag, and shipping the bag to a customer without inserting the bag in any other container. Methods of unpacking the cushion from the bag includes uncoupling the first end piece from the tubular sleeve, opening the tubular sleeve along a longitudinal length thereof, and unrolling the compressed cushion to an expanded form.

5 Claims, 5 Drawing Sheets

(56) References Cited

U.S. PATENT DOCUMENTS 3,842,977 A * 10/1974 Hollander ..... A45C 3/00 190/903
4,267,868 A * 5/1981 Lowe ..... A45C 7/0063 383/2
4,466,124 A * 8/1984 Kirkham, Jr. ..... A45F 3/04 224/153
4,503,558 A * 3/1985 Lief ..... A45C 7/0081 383/13
4,661,989 A * 4/1987 Risby ..... A47G 9/086 383/120
4,711,067 A * 12/1987 Magni ..... B65B 63/02 53/116
4,826,060 A * 5/1989 Hollingsworth ..... A45C 3/00 224/237
5,125,547 A * 6/1992 Russell ..... A45F 4/02 224/191
5,994,450 A 11/1999 Pearce
6,089,752 A * 7/2000 Moore ..... A45C 7/0063 383/103
6,098,378 A 8/2000 Wyatt
D465,922 S * 11/2002 Davis ..... D3/287
7,076,822 B2 7/2006 Pearce
7,083,331 B2 * 8/2006 Nykoluk ..... A45C 3/00 383/2
7,185,762 B2 * 3/2007 Ferris ..... B65D 33/10 206/525
7,631,376 B2 * 12/2009 Peterson ..... B65B 63/024 383/2
7,730,566 B2 6/2010 Flick et al.
7,964,664 B2 6/2011 Pearce
8,046,973 B2 11/2011 Petrolati
8,075,981 B2 12/2011 Pearce et al.
8,079,502 B2 * 12/2011 Montgomery ..... A45C 7/0063 224/579
D655,085 S * 3/2012 Holbrook ..... D3/289
D672,414 S * 12/2012 Januszek ..... D21/680
8,347,588 B2 1/2013 Oh
8,434,748 B1 5/2013 Pearce et al.
8,628,067 B2 1/2014 Pearce et al.
8,919,750 B2 12/2014 Pearce et al.
8,932,692 B2 1/2015 Pearce
D784,731 S * 4/2017 Pearce ..... D6/601
2003/0074863 A1 4/2003 Mossbeck
2003/0074864 A1 4/2003 Gecic
2004/0154105 A1 * 8/2004 Roseff ..... A47C 27/082 5/690
2005/0144911 A1 7/2005 Dextraze et al.
2005/0187075 A1 * 8/2005 Bellamy ..... A63B 21/0004 482/93
2006/0231436 A1 10/2006 Spinks et al.
2008/0098533 A1 5/2008 Erdman
2010/0227091 A1 9/2010 Pearce
2015/0203221 A1 7/2015 Van De Hey et al.
2015/0251843 A1 * 9/2015 Fux ..... B65D 85/16 206/459.5
2015/0359357 A1 12/2015 Feng et al.

OTHER PUBLICATIONS

Written Opinion of the International Searching Authority for PCT Application No. PCT/US2017/020788 dated Jun. 2, 2017, 10 pages.

* cited by examiner

BAG FOR SHIPPING A CUSHION AND RELATED METHODS

TECHNICAL FIELD

Embodiments of the disclosure relate generally to packaging for compressible cushions, including mattresses, mattress toppers, other bedding products, and seat cushions, to methods of packing and shipping the cushions in such packaging, and to methods of unpacking the cushions from such packaging.

BACKGROUND

Mattresses are bulky objects that are difficult and costly to transport from a manufacturer to a retailer or a customer. Traditionally, mattresses have been packaged, shipped, and sold in a flat configuration, such that the mattresses have the same size and dimension in shipping as they do when placed atop a box spring or other mattress support to make a bed. Recently, there have been efforts directed towards compressing mattresses, and there have been methods described for compressing foam and coil mattresses for packaging. Methods have also been disclosed for compressing the foam and coil mattresses into a rolled shape. Examples of methods of roll packing mattresses include: U.S. Pat. No. 8,046,973 to Petrolati, U.S. Patent Publication No. 2003/0074863 to Mossbeck, and U.S. Patent Publication No. 2015/0203221 to Van De Hey et al. The rolled mattresses are then placed into a cardboard box for shipping to a retailer or a customer.

BRIEF SUMMARY

In some embodiments, a bag for enclosing a cushion may comprise a tubular sleeve, a first end piece coupled to a first longitudinal end of the tubular sleeve, a second end piece coupled to a second longitudinal end of the tubular sleeve, a plurality of reinforcing straps encircling a circumference of the tubular sleeve proximate to the first longitudinal end and the second longitudinal end, and at least one handle extending longitudinally between the plurality of reinforcing straps. The at least one handle may be configured to lay flush against the tubular sleeve during shipment of the bag.

In some embodiments, the present disclosure includes a method of packaging and shipping a cushion. The method may comprise supplying the cushion to a roll packing machine. The cushion may be compressed and rolled into a cylindrical shape using the roll packing machine. The compressed cushion may be disposed in a cylindrical bag. The cylindrical bag may comprise a tubular sleeve, a first end piece coupled to a first longitudinal end of the tubular sleeve, a second end piece coupled to a second longitudinal end of the tubular sleeve, and at least one handle coupled to the tubular sleeve proximate to each of the first longitudinal end and the second longitudinal end of the tubular sleeve. The cylindrical bag may be shipped to a customer without inserting the cylindrical bag in any other container.

In some embodiments, a method of unpacking a compressed cushion from a cylindrical bag is disclosed. The cylindrical bag includes a tubular sleeve, a first end piece coupled to a first longitudinal end of the tubular sleeve, a second end piece coupled to a second longitudinal end of the tubular sleeve, and at least one reinforcing strap encircling a circumference of the tubular sleeve. The method comprises uncoupling the first end piece of the bag from the tubular sleeve. The tubular sleeve may be opened along a longitudinal length thereof. The compressed cushion may be removed from the cylindrical bag and unrolled to transform the compressed cushion to an expanded form.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

As used herein, any relational term, such as "first," "second," "top," "bottom," etc., is used for clarity and convenience in understanding the disclosure and accompanying drawings and does not connote or depend on any specific preference, orientation, or order, except where the context clearly indicates otherwise.

As used herein, the term "and/or" means and includes any and all combinations of one or more of the associated listed items.

The illustrations presented herein are not meant to be actual views of any particular component, device, or system, but are merely idealized representations that are employed to describe embodiments of the present disclosure. Elements common between figures may retain the same numerical designation.

The present disclosure describes a cushion or other bedding product that may be roll packed, folded, and/or compressed for shipping to a customer. The other bedding product may include mattress pads or toppers, comforters, etc. The compressed cushion or other bedding product may be disposed in a cylindrical bag configured to be shipped to a customer without additional packaging, such as without being placed in a cardboard box, without palletizing, etc.

Figure 1:
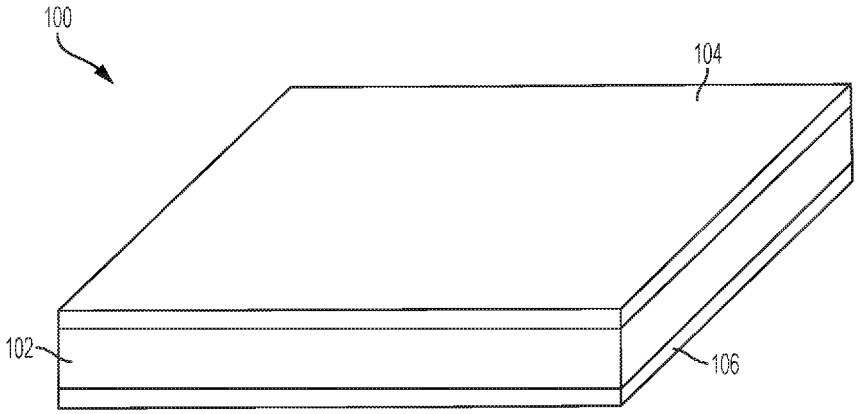
FIG. 1 is a perspective view of a cushion in an expanded form according to an embodiment of the present disclosure.

FIG. 1 illustrates a perspective view of a cushion 100 according to some embodiments of the present disclosure. The cushion 100 may comprise an elastomeric cushioning element 102 between a top layer 104 and a bottom layer 106.

In some embodiments, the top layer 104 and the bottom layer 106 may comprise a foam material. In other embodiments, the top layer 104 may comprise a stretchable material that may be secured to or be integral with the elastomeric cushioning element 102. Such a stretchable material is described in U.S. patent application Ser. No. 15/062,621, titled "Mattresses and Mattress Toppers Including Knitted Fabric, and Related Methods," filed Mar. 7, 2016, assigned to the assignee of the present application, the entire disclosure of which is incorporated herein by this reference. In yet other embodiments, the cushion 100 may comprise additional layers.

Figure 2:
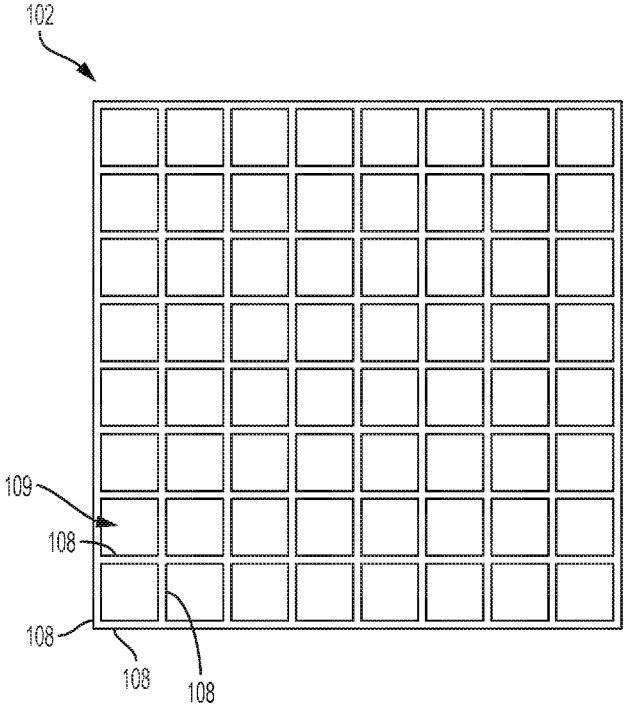
FIG. 2 is a top view of an elastomeric cushioning element of the cushion of FIG. 1 according to an embodiment of the present disclosure.

FIG. 2 illustrates a simplified top view of the elastomeric cushioning element 102. The elastomeric cushioning element 102 may comprise intersecting buckling walls 108 that are interconnected and define hollow columns 109 or voids. Though the buckling walls 108 are depicted as intersecting at right angles, the buckling walls 108 may be in any selected configuration. For example, the buckling walls 108 may be configured to form triangular hollow columns 109, hexagonal hollow columns 109, skewed parallelogram hollow columns 109, etc.

The elastomeric cushioning element 102 may have any selected dimensions based on the intended use. For example, if the cushion 100 is a mattress for a queen size bed, the elastomeric cushioning element 102 may be approximately 60 inches (152 cm) by 80 inches (203 cm), with a thickness of about 2 inches (5.08 cm). In some embodiments, the thickness of the elastomeric cushioning element 102 may be between about 1 inch (2.54 cm) and about 10 inches (25.4 cm), such as from about 2 inches (5.08 cm) to about 6 inches (15.24 cm). The thickness of the elastomeric cushioning element 102 may vary based on the thickness of other parts of the cushion 100. In some embodiments, the elastomeric cushioning element 102 may be configured to be used instead of a support core of springs or firm foam as used in a conventional mattress.

The elastomeric cushioning element 102 may include, for example, an elastomeric cushioning material as described in U.S. Pat. No. 7,076,822, "Stacked Cushions," issued Jul. 18, 2006; U.S. Pat. No. 7,730,566, titled "Multi-Walled Gelastic Material," issued Jun. 8, 2010; U.S. Pat. No. 8,075,981, titled "Alternating Pattern Gel Cushioning Elements and Related Methods," issued Dec. 13, 2011; U.S. Pat. No. 8,434,748, titled "Cushions Comprising Gel Springs," issued May 7, 2013 (hereinafter "the '748 Patent"); U.S. Pat. No. 8,628,067, titled "Cushions Comprising Core Structures and Related Methods," issued Jan. 14, 2014 (hereinafter "the '067 Patent"); U.S. Pat. No. 8,919,750, titled "Cushioning Elements Comprising Buckling Walls and Methods of Forming Such Cushioning Elements," issued Dec. 30, 2014 (hereinafter "the '750 Patent"); U.S. patent application Ser. No. 15/062,621, titled "Mattresses and Mattress Toppers Including Knitted Fabric, and Related Methods," filed Mar. 7, 2016, assigned to the assignee of the present application, the entire disclosures of each of which is hereby incorporated herein by this reference.

While FIG. 2 illustrates the elastomeric cushioning element 102 as intersecting buckling walls 108 having hollow columns 110, other structures and configurations may be used. Such additional structures and configurations are described in, for example, the '748 Patent; the '067 Patent; the '750 Patent; and U.S. Pat. No. 8,932,692, titled "Cushions Comprising Deformable Members and Related Methods," issued Jan. 13, 2015, the entire disclosure of each of which is incorporated herein by this reference.

In some embodiments, the cushion 100 or other bedding products may be roll-packed and take on a cylindrical shape before being disposed in a bag for shipment. In other embodiments, the cushion 100 or other bedding products may be roll-packed and/or folded once before being disposed in a bag for shipment. In yet other embodiments, the cushion 100 or other bedding products may be roll-packed and/or folded at least twice before being disposed in a bag for shipment.

Figure 3:
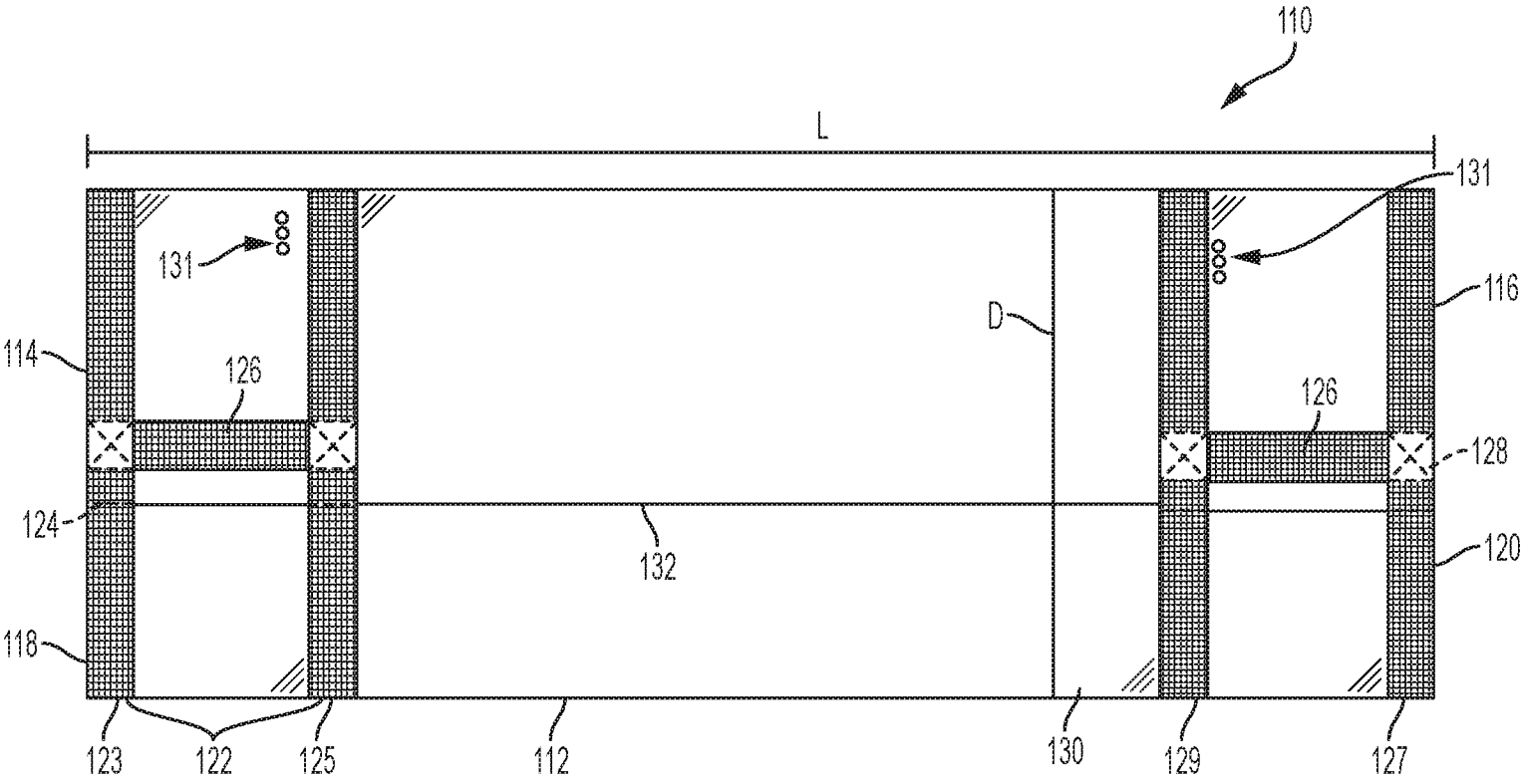
FIG. 3 is a side view of a bag for packaging and shipping cushions according to an embodiment of the present disclosure.
Figure 4:
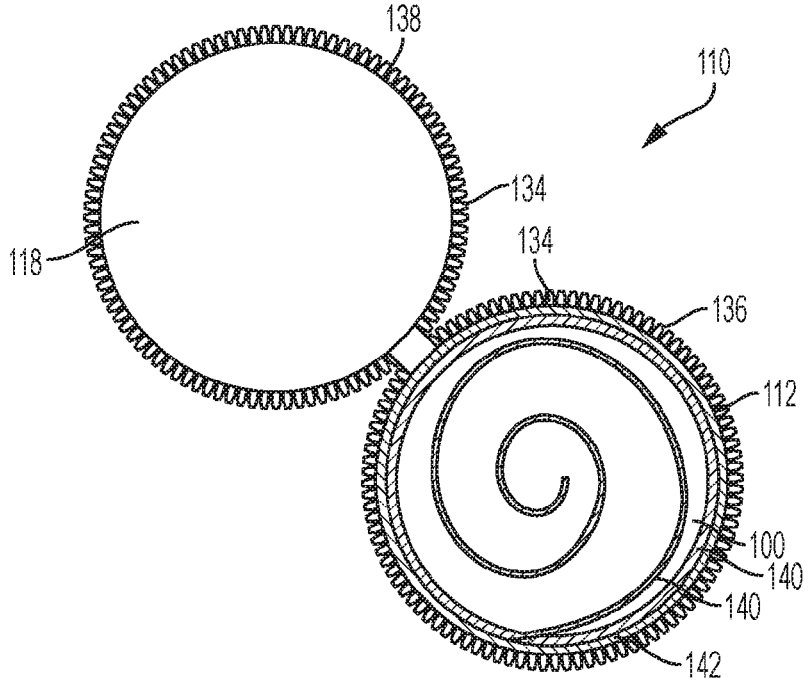
FIG. 4 is an end view of the bag of FIG. 3 enclosing the cushion of FIG. 1 in a compressed form according to an embodiment of the present disclosure.

FIGS. 3 and 4 illustrate a side view and an end view of a bag 110 according to some embodiments of the present disclosure. The bag 110 may be sized and configured to enclose the cushion 100 of FIG. 1 in a compressed form as illustrated in FIG. 4. In some embodiments, the bag 110 may have a cylindrical shape configured to enclose a roll-packed cushion 100. In other embodiments, the bag 110 may have a rectangular shape configured to enclose a folded cushion 100.

The bag 110 may comprise a tubular sleeve 112 having a first longitudinal end 114 and a second longitudinal end 116. A first end piece 118 may be coupled to the tubular sleeve 112 at the first longitudinal end 114, and a second end piece 120 may be coupled to the tubular sleeve 112 at the second longitudinal end 116. A plurality of reinforcing straps 122 may be coupled (e.g., by stitching 124) to the tubular sleeve 112 proximate to the first longitudinal end 114 and the second longitudinal end 116. At least one handle 126 may be attached to the tubular sleeve 112 proximate to the first longitudinal end 114 and the second longitudinal end 116. The handle 126 may extend longitudinally between the reinforcing straps 122. The tubular sleeve 112 may further comprise ventilation perforations 131 configured to reduce the danger of suffocation potentially presented to young children by the bag 110. The tubular sleeve 112 may be formed from a sheet 130 of a first material attached to itself by a seam 132 extending along a longitudinal length L of the tubular sleeve 112. The tubular sleeve 112 may be configured to receive stickers and other markings, such as shipping labels, warning labels, and screen printing for informational and branding purposes.

In some embodiments, the sheet 130 may comprise a flexible, thermoplastic polymer. By way of non-limiting example, the thermoplastic polymer may comprise polyvinyl chloride, polyethylene, polypropylene, polyethylene terephthalate, polyethylene terephthalate glycol-modified, and the like. In other embodiments, the sheet 130 may comprise a woven fabric of polypropylene, polyester, nylon, rayon, viscose, and the like. In yet further embodiments, the sheet 130 may comprise a non-woven fabric of polypropylene, polyester, nylon, and the like.

The sheet 130 may be clear, translucent, or opaque. In some embodiments, the cushion 100 and other objects enclosed within the bag 110, such as printed materials, may be at least partially visible through the sheet 130. In some embodiments, the sheet 130 may be color tinted. The transparency and tint of the sheet 130 may be varied for aesthetic purposes.

The sheet 130 may be selected to have a thickness in a range extending from 0.003 inch to about 0.040 inch and, more particularly, from about 0.006 inch to about 0.030 inch in some embodiments. In other embodiments, the thickness may be about 0.015 inch. The thickness of the sheet 130 may vary based on the composition of the sheet 130 and based on the dimensions and weight of the cushion 100 disposed within the bag 110. The thickness of the sheet 130 may be at least sufficient to prevent damage to and to provide support to the cushion 100 disposed in the bag 110 in storage and/or during shipment.

In some embodiments, the seam 132 may be formed by sewing or stitching the sheet 130 to itself. In other embodiments, the seam 132 may comprise a plastic weld formed by plastic welding the seam 132. A method of plastic welding the seam 132 may comprise using at least one of a high frequency welding process, a heat sealing process, or an ultrasonic welding process. In yet other embodiments, the seam 132 may comprise a zipper.

With reference to FIG. 4, the first end piece 118 may be removably coupled to the tubular sleeve 112 at the first longitudinal end 114 by a zipper 134 having two rows of protruding teeth. A first row of protruding teeth 136 of the zipper 134 may be attached about a circumference of the tubular sleeve 112 adjacent to (e.g., proximate to) the first longitudinal end 114. The first row of protruding teeth 136 may be attached by, for example, stitching to a reinforcing strap 122 proximate to the first longitudinal end 114 or by stitching directly to the tubular sleeve 112. In other embodiments, the first row of protruding teeth 136 of the zipper 134 may be attached to the tubular sleeve 112 or the reinforcing strap 122 using binding tape. A second row of protruding teeth 138 of the zipper 134 may be attached about a circumference of the first end piece 118. The second row of protruding teeth 138 of the zipper 134 may be attached by, for example, stitching to the first end piece 118 with or without binding tape. The second end piece 120 may be coupled to the tubular sleeve 112 at the second longitudinal end 116 by, for example, stitching to a reinforcing strap 122 proximate to the second longitudinal end 116 or by stitching directly to the tubular sleeve 112 with or without use of binding tape. In other embodiments, a zipper, such as the zipper 134 may also be provided about a circumference of the second end piece 120 and the tubular sleeve 112 such that the second end piece 120 may also be removably coupled to the tubular sleeve 112.

In some embodiments, the first and second end pieces 118, 120 may comprise a material different from the material of the sheet 130. For example, the first and second end pieces 118, 120 may comprise a woven or non-woven fabric. By way of non-limiting example, the woven fabric may comprise polypropylene, polyester, nylon, rayon, viscose, and the like, and the non-woven fabric may comprise polyester, polypropylene, nylon, and the like. In other embodiments, the first and second end pieces 118, 120 may comprise a material similar to the material of the sheet 130. For example, the first and second end pieces 118, 120 may comprise a flexible, thermoplastic polymer, such as polyvinyl chloride, polyethylene, polypropylene, polyethylene terephthalate, polyethylene terephthalate glycol-modified, and the like. In yet other embodiments, the thermoplastic polymer of the first and second end pieces 118, 120 may be provided with stippling such that the thermoplastic polymer has an aesthetic appearance similar to a woven fabric.

With reference to FIG. 3, the plurality of reinforcing straps 122 may encircle a circumference of the tubular sleeve 112. The reinforcing straps 122 may be configured to provide structural support to the bag 110 during shipment. In other words, the reinforcing straps 122 may be configured to maintain a cylindrical shape of the tubular sleeve 112 of the bag 110. The reinforcing straps 122 may also be configured to provide support to the handles 126 by which the bag 110 may be lifted. A first reinforcing strap 123 may be attached to the tubular sleeve 112 adjacent to the first longitudinal end 114. A second reinforcing strap 125 may be attached to the tubular sleeve 112 proximate to the first longitudinal end 114 and distal to the first reinforcing strap 123. The first and second reinforcing straps 123, 125 may be separated by a distance sufficient to provide at least one handle 126 extending longitudinally therebetween. A third reinforcing strap 127 may be attached to the tubular sleeve 112 adjacent to the second longitudinal end 116. A fourth reinforcing strap 129 may be attached to the tubular sleeve 112 proximate to the second longitudinal end 116 and distal to the third reinforcing strap 127. The third and fourth reinforcing straps 127, 129 may be separated by a distance sufficient to provide at least one handle 126 extending longitudinally therebetween. Handles 126 may not extend between the second reinforcing strap 125 and the fourth reinforcing strap 129. In some embodiments, more than four reinforcing straps may encircle the circumference of the tubular sleeve 112.

Each longitudinal end of the handles 126 may be coupled to the reinforcing straps 122 by, for example, box-and-x stitching 128. The handles 126 may be configured to lay flush with the tubular sleeve 112 during shipment such that the handles 126 do not catch or otherwise become damaged by equipment used during shipment.

In some embodiments, the bag 110 may comprise an equal number of handles 126 at each longitudinal end 114, 116 thereof. For example, the bag 110 may comprise at least two handles 126 with one handle 126 extending between the first and second reinforcing straps 123, 125 and one handle 126 provided between the third and fourth reinforcing straps 127, 129. In other embodiments, the bag 110 may comprise at least four handles 126 with two handles 126 extending between the first and second reinforcing straps 123, 125 and two handles 126 between the third and fourth reinforcing straps 127, 129. The number of handles 126 may exceed four in yet other embodiments. In yet other embodiments, the bag 110 may comprise an unequal number of handles 126 at each longitudinal end 114, 116 thereof.

In embodiments in which the bag comprises at least two handles 126 extending between the first and second reinforcing straps 123, 125 and/or at least two handles 126 one handle 126 provided between the third and fourth reinforcing straps 127, 129, the handles 126 may be evenly spaced (i.e., separated by an equal distance) about the circumference of the bag 110. In other embodiments, the handles 126 may not be evenly spaced (i.e., separated by an unequal distance) about the circumference of the bag 110. For example, the handles may be spaced apart by a distance in a range extending from about 6 inches (15.2 cm) to about 40 inches (101.6 cm). In yet other embodiments, the handles 126 may be spaced apart such that the handles 126 extending between the first and second reinforcing straps 123, 125 and the handles 126 extending between the third and fourth reinforcing straps 127, 129 are each visible in a side view of the bag 110 when the bag 110 is laying longitudinally (i.e., along its length L), as illustrated in FIG. 3. The handles 126 may be separated by an equal distance as measured from the seam 132. For example, the handles 126 may be separated from the seam 132 by a distance in a range from about 3 inches (7.62 cm) to about 8 inches (20.3 cm).

The handles 126 and the reinforcing straps 122 may be formed of and comprise the same material. For example, the handles 126 and the reinforcing straps 122 may comprise a woven fabric. In some embodiments, the woven fabric may comprise nylon or polypropylene webbing. The woven fabric may have a breaking strength sufficient to bear the weight of the cushion 100 when the bag 110 may be lifted using handles 126. The woven fabric may have a breaking strength in a range extending from about 600 lbs to about 6000 lbs or in a range greater than about 6000 lbs depending on the composition and width of the reinforcing straps 122 and the handles 126. The breaking strength of the woven fabric may be selected based on the dimensions, including size and weight, of the cushion 100 or other bedding product disposed in the bag 110.

A length L and a diameter D and/or width of the bag 110 may be varied based on the intended use. For example, the length L and diameter D may be varied to extend approximately the same length and diameter and/or width as the cushion 100 or other bedding products in compressed form to be disposed therein. By way of further non-limiting example, if the cushion 100 is a mattress for a king size bed, the bag 110 may have a length of approximately 76 inches (193 cm) and a width of approximately 16 inches (40.6 cm). In other embodiments, if the cushion 100 is a mattress for a king size bed and the cushion 100 is folded at least once before being rolled, the bag 110 may have a length of approximately 38 inches (193 cm) and a width of approximately 16 inches (40.6 cm). If the cushion 100 is a mattress for a queen size bed, the bag 110 may have a length of approximately 60 inches (152.4 cm) and a width of approximately 80 inches (203.2 cm). If the cushion 100 is a mattress for an extra-long twin size mattress, the bag 110 may have a length of approximately 38 inches (96.5 cm) and a width of approximately 16 inches (40.6 cm). The difference between the diameter D of the bag 110 and the diameter of the cushion 100 in compressed form may be sufficient to allow the cushion 100 to be disposed therein. The difference between the diameter D of the bag 110 and the diameter of the cushion 100 in compressed form may not be sufficient to permit formation of air pockets or gaps between the bag 110 and the cushion 100 disposed therein.

FIG. 4 illustrates an end view of the bag 110 having a cushion 100 in a compressed form disposed therein. A sheet 140 may be wrapped around an exterior surface and a circumference of the cushion 100 during a roll packing process, as described with reference to FIG. 6. A sleeve 142 may also be provided about a circumference of the cushion 100 in some embodiments.

The sheet 140 may comprise a non-woven fabric in some embodiments. The non-woven fabric may comprise polypropylene, polyester, nylon, and the like. In other embodiments, the sheet 140 may comprise a woven fabric comprising polypropylene, polyester, nylon, rayon, viscose, and the like. The sheet 140 may be configured to prevent expansion of the cushion 100 and to prevent the pressure exerted internally on the bag 110 by the cushion 100 from increasing during storage and/or shipment. The sheet 140 may further prevent soiling, tearing, or other damage to the cushion 100 in the event damage occurs to the bag 110 during storage and/or shipment. In embodiments in which the tubular sleeve 112 may be clear or translucent, the sheet 140 may be color tinted to add to the aesthetics of the bag 110 and may include graphics and product information visible through the tubular sleeve 112.

In some embodiments, the cushion 100 having the sheet 140 wrapped thereabouts may be disposed in the sleeve 142. In other embodiments, the cushion 100 may be disposed in the sleeve 142 without having the sheet 140 wrapped thereabouts. The sleeve 142 may be configured to prevent expansion of the cushion 100 and to prevent the pressure exerted internally on the bag 110 by the cushion 100 from increasing during storage and/or shipment in addition to the sheet 140 or in place of the sheet 140. The sleeve 142 may comprise a flexible, thermoplastic polymer, such as polyvinyl chloride, polyethylene, polypropylene, polyethylene terephthalate, polyethylene terephthalate glycol-modified, and the like.

Figure 5:
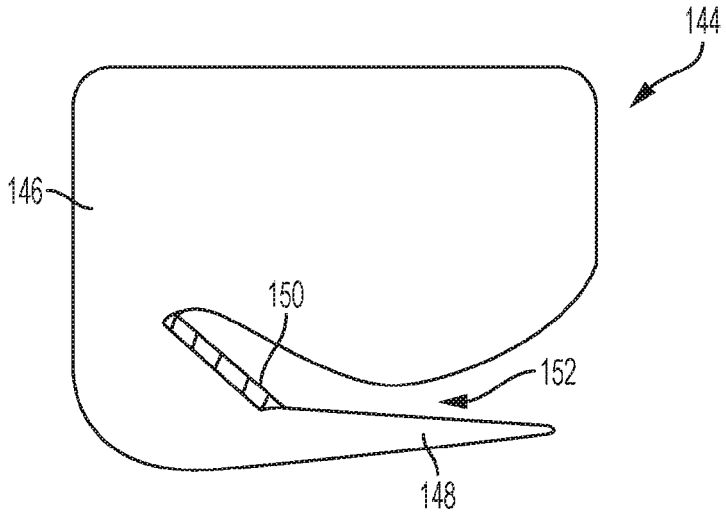
FIG. 5 is a side view of a slitter for opening the bag of FIGS. 3 and 4 by cutting the bag using the slitter according to an embodiment of the present disclosure.

FIG. 5 illustrates a side view of a slitter 144 that may be disposed in the bag 110. The slitter 144 may comprise a grip portion 146, a guide portion 148, and a blade 150 located in an opening 152 there between. The grip portion 146 may be sized and configured to allow a customer to grip the slitter 144 and cut the bag 110 with one hand. The guide portion 148 may be configured to slide between the bag 110 and the cushion 100 during cutting. The guide portion 148 may further be configured to lift the bag 110 away from the cushion 100 to eliminate the risk of cutting the cushion 100 while cutting the bag 110. The blade 150 may be disposed in the opening 152 at an angle and may be configured to cut through the zipper 134, the plurality of reinforcing straps 122, and the tubular sleeve 112. The blade 150 may be recessed in the opening 152 to prevent a customer from cutting themselves while cutting the bag 110.

Figure 6:
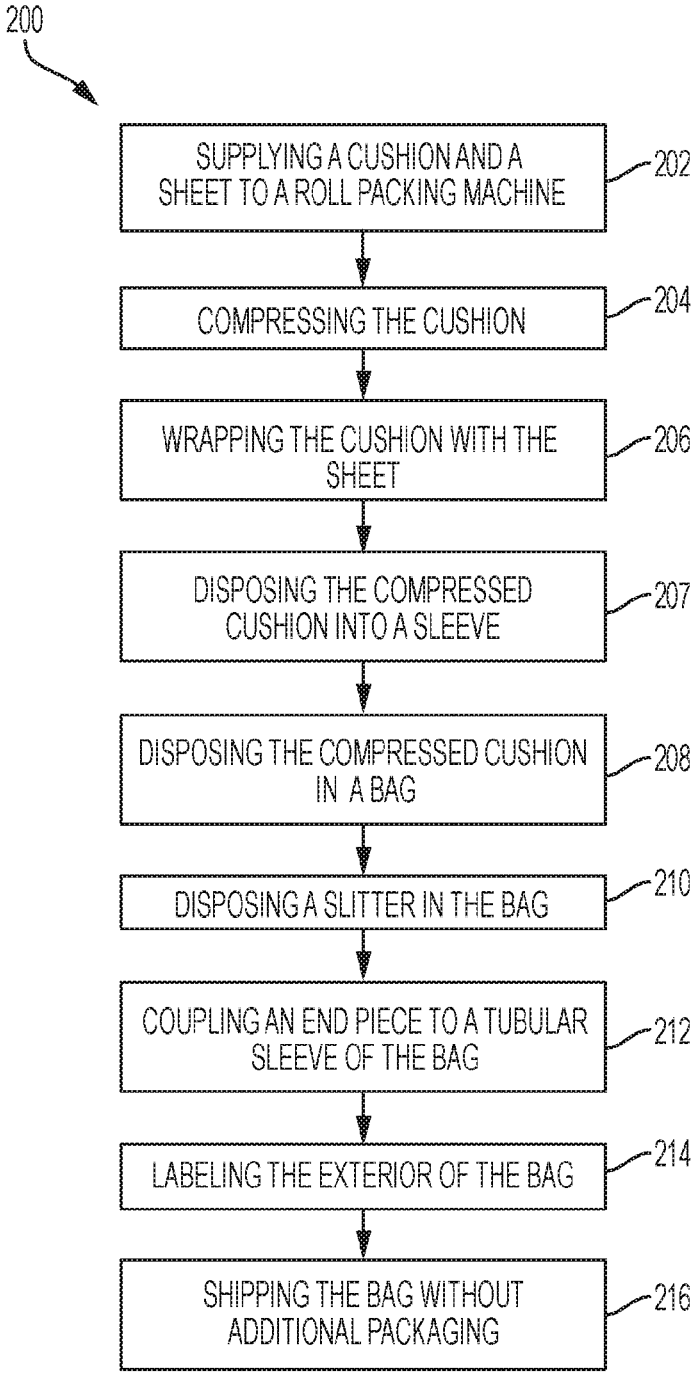
FIG. 6 is a flow chart of a method of packing and shipping cushions in the bag of FIGS. 3 and 4 according to an embodiment of the present disclosure.

The cushion 100 of FIG. 1 may be disposed in the bag 110 as illustrated in FIG. 4 by a method as illustrated in FIG. 6. FIG. 6 is a process flow diagram 200 illustrating a method of packing and shipping the cushion 100 (FIG. 1) in the bag 110. At action 202, the cushion 100 may be provided on a conveyor belt, table, or other platform adjacent to an entrance of a roll packing machine. In some embodiments, the sheet 140 may be provided over a top surface of the cushion 100 at action 202. The sheet 140 may have a length greater than a length of the cushion 100. The length of the sheet 140 may be sufficient to be wrapped within folds of the cushion 100 as the cushion 100 is roll packed as illustrated in FIG. 4. The length of the sheet 140 may also be sufficient to be wrapped around a circumference of the cushion 100 in a compressed form once. In some embodiments, the length of the sheet 140 may be sufficient to be wrapped around the circumference of the cushion 100 in a compressed form more than once. The sheet 140 may also have a width greater than a width of the cushion 100. In some embodiments, the cushion 100 and the sheet 140 may be simultaneously conveyed into (e.g., supplied to) the roll packing machine. In other embodiments, the cushion 100 is inserted into the roll packing machine without the sheet 140.

At action 204, the roll packing machine may compress the cushion 100 into a rolled, cylindrical shape and/or a folded configuration. By way of non-limiting example, methods of roll packing mattresses are disclosed in U.S. Pat. No. 8,046,973, titled "Machine for Packaging Mattresses," issued Nov. 1, 2011, U.S. Patent Publication No. 2003/0074863, titled "Method for Roll Packing Foam Cores," filed Oct. 22, 2001, and U.S. Patent Publication No. 2015/0203221, titled "System and Method for Packaging a Foam Product," filed Jan. 12, 2015, the disclosures of each of which is incorporated herein by this reference. During the roll packing process, the sheet 140, which is optionally provided, may be wrapped about an exterior surface and about a circumference of the cushion 100 in action 206 at least once. An adhesive, such as tape or glue, may be provided on sheet 140 to secure the sheet 140 to itself.

At action 207, the roll packed and/or folded (e.g., compressed) cushion 100 optionally having the sheet 140 wrapped thereabouts may be disposed into the sleeve 142. The cushion 100 may be manually disposed or machine inserted by the roll packing machine into the sleeve 142.

At action 208, the compressed cushion 100 optionally having the sheet 140 and/or the sleeve 142 provided thereabouts may be disposed in the bag 110. In embodiments in which the bag 110 comprises stitching or plastic welding as the seam 132, the cushion 100 may be manually disposed or machine inserted by the roll packing machine in the first longitudinal end 114 of the bag 110 and may abut against the second end piece 120 of the bag 110. In other embodiments in which a zipper may be provided as the seam 132, the cushion 100 may disposed in the bag 110 by abutting a first longitudinal end of the cushion 100 against the second end piece 120 either manually or by the roll packing machine and by closing the zipper along the longitudinal length L of the tubular sleeve 112.

At action 210, the slitter 144 or other cutting device may be disposed in the bag 110. In some embodiments, in which the tubular sleeve 112 is clear or transparent, shipping labels, warning labels, and other product labels may also be disposed in the bag 110 at action 210. The zipper 134 may be closed (e.g., the first row of teeth 136 may be coupled to the second row of teeth 138) and the first end piece 118 coupled to the tubular sleeve 112 to enclose the cushion 100 in the bag 110 at action 212. Shipping labels, warning labels, and other product labels may be attached to an exterior surface of the bag 110 at action 214.

At action 216, the bag 110 may be provided to a courier and transported to a customer without inserting the bag 110 into any additional packaging. For example, the bag 110 may be shipped without disposing the bag 110 into a cardboard box as compressed mattresses are traditionally shipped. Such boxes are prone to denting or tearing at the corners of the box that are unsupported due to gaps between the exterior of the rolled mattress and the interior of the cardboard box. The bag 110 may be configured to maintain its shape and to maintain an unimpaired or untorn condition during physical handling of the bag 110 during shipping. Physical handling may include conveyance by conveyor belts or other equipment, lifting and/or carrying by the handles 126, pulling or pushing on the bag 110 at the end pieces 118, 120 or the tubular sleeve 112, stacking the bag 112 under and/or on other packages being transported, etc.

Figure 7:
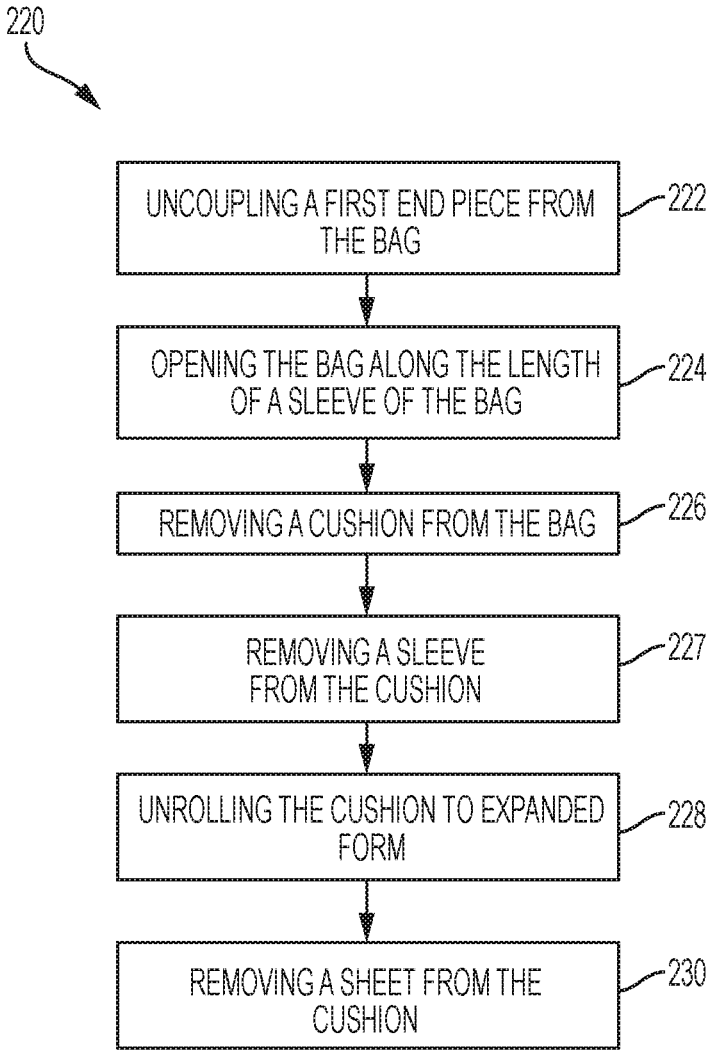
FIG. 7 is a flow chart of a method of unpacking cushions from the bag of FIGS. 3 and 4 according to an embodiment of the present disclosure.

FIG. 7 is a process flow diagram 220 illustrating a method of removing the cushion 100 from the bag 110 illustrated in FIGS. 3 and 4. The method may include uncoupling the first end piece 118 from the tubular sleeve 112 of the bag 110 by opening the zipper 134 at action 222. In other words, the first row of teeth 136 of the zipper 134 may be uncoupled from the second row of teeth 138 of the zipper 134. In some embodiments, a customer may remove the cushion 100 (action 226) through the first longitudinal end 114 of the bag 110 without further opening the bag 110.

In other embodiments, the bag 110 may be opened along the longitudinal length L of the tubular sleeve 112 at action 224. In some embodiments, the bag 110 may be opened using scissors, a box cutter, the slitter 144 (FIG. 5), or the like to cut through the first row of protruding teeth 136 of the zipper 134, through the reinforcing straps 122, and through the tubular sleeve 112. The first row of protruding teeth 136 may be cut in a direction transverse to the direction in which the zipper 134 may be opened or closed. By cutting through each of the zipper 134, the reinforcing straps 122, and the tubular sleeve 112, the bag 110 may not be reusable, and the danger of suffocation potentially presented to young children by the bag 110 may be eliminated.

In other embodiments in which the bag 110 comprises a lengthwise zipper at the seam 132, the bag 110 may be opened by opening the zipper at action 224. In such embodiments, the bag 110 may be reused for storage of, for example, multiple sleeping bags, other rolled bedding products, and the like and may otherwise be of value to a customer.

The cushion 100 may be removed from the opened bag 110 at action 226. The cushion 100 may be removed from the bag 110, for example, by lifting or rolling the cushion 100 away from the bag 110 and placing the cushion 100 on a support surface, such as a bed frame, box spring, or the like. At action 227, the sleeve 142, which may optionally be provided about the cushion 100, may be removed from the cushion 100. The sleeve 142 may be removed by, for example, cutting the sleeve 142 along its longitudinal length using the slitter 144 or the like. At action 228, the cushion 100 may be unrolled and may begin to transfol in to an expanded folin. The cushion 100 may be unrolled by pulling the sheet 140, which may be optionally provided about the cushion 100, away from the cushion 100 causing the cushion 100 to rotate and be released from the sheet 140.

At action 230, the sheet 140 may be removed from the cushion 100 allowing the cushion 100 to transform fully to the expanded form, as illustrated at FIG. 1. In other embodiments, the cushion 100 may transform to the expanded form before the sheet 140 may be removed from the cushion 100.

Additional non-limiting example embodiments of the disclosure are described below.

Embodiment 1

A method of packaging and shipping a cushion comprising supplying a cushion to a roll packing machine, compressing the cushion into a cylindrical shape using the roll packing machine, disposing the compressed cushion into a cylindrical bag, and shipping the compressed cushion to a customer in the cylindrical bag without inserting the cylindrical bag in any other container. The cylindrical bag comprising a tubular sleeve, a first end piece coupled to a first longitudinal end of the tubular sleeve, a second end piece coupled to a second longitudinal end of the tubular sleeve, and at least one handle attached to the tubular sleeve proximate to each of the first longitudinal end and the second longitudinal end.

Embodiment 2

The method of Embodiment 1, further comprising selecting the tubular sleeve to comprise a thermoplastic polymer.

Embodiment 3

The method of Embodiment 2, further comprising selecting the thermoplastic polymer to comprise polyvinyl chloride.

Embodiment 4

The method of Embodiment 1, further comprising selecting the tubular sleeve to comprise a woven or non-woven fabric.

Embodiment 5

The method of any of Embodiments 1 through 4, further comprising supplying a sheet with the cushion to the roll packing machine and wrapping the sheet around an exterior surface of the cushion using the roll packing machine.

Embodiment 6

The method of Embodiment 5, further comprising selecting the sheet to comprise a non-woven fabric.

Embodiment 7

The method of Embodiment 5 or 6, wherein the sheet is configured to prevent expansion of the compressed cushion.

Embodiment 8

The method of any of Embodiments 1 through 7, further comprising disposing the compressed cushion into a sleeve.

Embodiment 9

The method of Embodiment 8, further comprising selecting the sleeve to comprise a thermoplastic polymer.

Embodiment 10

The method of Embodiment 9, further comprising selecting the thermoplastic polymer to comprise polyethylene.

Embodiment 11

The method of any of Embodiments 1 through 10, wherein disposing the compressed cushion into the cylindrical bag comprises inserting the compressed cushion into the cylindrical bag through the first longitudinal end of the tubular sleeve and closing a zipper provided about a circumference of the first end piece and about a circumference of the tubular sleeve.

Embodiment 12

The method of any of Embodiments 1 through 11, further comprising stitching a seam along a longitudinal length of the tubular sleeve.

Embodiment 13

The method of any of Embodiments 1 through 11, further comprising plastic welding a seam along a longitudinal length of the tubular sleeve.

Embodiment 14

The method of Embodiment 13, wherein plastic welding the seam comprises using at least one of a high frequency welding process, a heat sealing process, or an ultrasonic welding process.

Embodiment 15

A method of unpacking a compressed cushion from a cylindrical bag comprising uncoupling a first end piece from a tubular sleeve of the cylindrical bag, opening a tubular sleeve along a longitudinal length of the cylindrical bag, removing the compressed cushion from the cylindrical bag, and unrolling the compressed cushion from the cylindrical bag to transform the compressed cushion to an expanded form. The cylindrical bag comprises a tubular sleeve, a first end piece coupled to a first longitudinal end of the tubular sleeve, a second end piece coupled to a second longitudinal end of the tubular sleeve, and at least one reinforcing strap encircling a circumference of the cylindrical bag.

Embodiment 16

The method of Embodiment 15, wherein opening the tubular sleeve of the cylindrical bag comprises cutting the cylindrical bag along a longitudinal length thereof.

Embodiment 17

The method of Embodiment 15 or 16, wherein opening the tubular sleeve of the cylindrical bag comprises cutting through the at least one reinforcing strap.

Embodiment 18

The method of any of Embodiments 15 through 17, wherein opening the tubular sleeve of the cylindrical bag comprises cutting a zipper provided about a circumference of the tubular sleeve proximate to the first longitudinal end thereof in a direction transverse to a direction of opening the zipper.

Embodiment 19

The method of any of Embodiments 15 through 18, wherein uncoupling the first end piece of the bag from the tubular sleeve of the bag comprises opening a zipper provided about a circumference of the first end piece and about a circumference of the tubular sleeve proximate to the first longitudinal end thereof.

Embodiment 20

A bag for enclosing a cushion comprising a tubular sleeve, a first end piece coupled to a first longitudinal end of the tubular sleeve, a second end piece coupled to a second longitudinal end of the tubular sleeve, a plurality of reinforcing straps encircling a circumference of the tubular sleeve proximate to each of the first longitudinal end and the second longitudinal end of the tubular sleeve, and at least one handle extending longitudinally between the plurality of reinforcing straps and configured to lay flush against the tubular sleeve during shipping.

Embodiment 21

The bag of Embodiment 20, further comprising at least one of a stitched seam or a plastic weld extending along a length of the tubular sleeve.

Embodiment 22

The bag of Embodiment 20 or 21, wherein the first end piece is removably coupled to the first longitudinal end by a zipper extending about a circumference of the first end piece and a circumference of the first longitudinal end of the tubular sleeve.

Embodiment 23

The bag of any of Embodiments 20 through 22, wherein each of the at least one handle and the plurality of reinforcing straps comprises a woven fabric.

Embodiment 24

The bag of any of Embodiments 20 through 23, wherein the woven fabric comprises at least one of nylon webbing or polypropylene webbing.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated by the inventors.

What is claimed is:

1. A bag for enclosing a cushion, the bag comprising:

a tubular sleeve;

a first end piece coupled to a first longitudinal end of the tubular sleeve;

a second end piece coupled to a second longitudinal end of the tubular sleeve;

a first pair of reinforcing straps encircling a circumference of the tubular sleeve proximate to the first longitudinal end of the tubular sleeve;

a second pair of reinforcing straps encircling the circumference of the tubular sleeve proximate to the second longitudinal end of the tubular sleeve;

a first handle extending longitudinally between the first pair of reinforcing straps lying flush against the tubular sleeve during shipping; and a second handle extending longitudinally between the second pair of reinforcing straps and lying flush against the tubular sleeve during shipping, the second handle discrete from the first handle.

2. The bag of claim 1, further comprising at least one of a stitched seam or a plastic weld extending along a length of the tubular sleeve.

3. The bag of claim 1, wherein the first end piece is removably coupled to the first longitudinal end by a zipper extending about a circumference of the first end piece and a circumference of the first longitudinal end of the tubular sleeve.

4. The bag of claim 1, wherein each of the first handle, the second handle, the first pair of reinforcing straps, and the second pair of reinforcing straps comprises a woven fabric.

5. The bag of claim 4, wherein the woven fabric comprises at least one of nylon webbing or polypropylene webbing.

* * * * *